US005257837A

United States Patent [19]

Bishop

[11] Patent Number: 5,257,837

[45] Date of Patent: Nov. 2, 1993

[54] DOOR LATCH WITH ADJUSTABLE BACKSET AND DEADLOCKING FEATURE

[75] Inventor: Stephen P. Bishop, Vancouver, Canada

[73] Assignee: Masco Building Products Corp., Seal Beach, Calif.

[21] Appl. No.: 862,849

[22] Filed: Apr. 3, 1992

Related U.S. Application Data

[63] Continuation-in-part of Ser. No. 845,417, Mar. 3, 1992, Pat. No. 5,169,184.

[51] Int. Cl.[5] ..... E05C 1/16

[52] U.S. Cl. ..... 292/1.5; 292/DIG. 60

[58] Field of Search ..... 292/1.5, 337, DIG. 60

[56] References Cited

U.S. PATENT DOCUMENTS

| | | | |
|---|---|---|---|
| 2,634,151 | 4/1953 | Russell et al. | 292/337 |
| 2,656,207 | 10/1953 | Russell et al. | 292/169 |
| 2,674,481 | 4/1954 | Russell et al. | 292/169.19 |
| 3,414,307 | 12/1968 | Russell | 292/2 |
| 3,790,196 | 2/1974 | Sanders et al. | 292/140 |
| 3,799,592 | 3/1974 | Babb, Jr. et al. | 292/140 |
| 3,799,593 | 3/1974 | Dielman | 292/145 |
| 4,060,267 | 11/1977 | Monfardini | 292/173 |
| 4,333,324 | 6/1982 | Dietrich et al. | 70/107 |
| 4,372,594 | 2/1983 | Gater | 292/337 |
| 4,427,224 | 1/1984 | Bergen | 292/169.23 |
| 4,602,490 | 7/1986 | Glass et al. | 70/134 |
| 4,615,549 | 10/1986 | Couture | 292/169.21 |
| 4,623,174 | 11/1986 | Trull et al. | 292/1 |
| 4,653,787 | 3/1987 | Fang | 292/337 |
| 4,662,665 | 5/1987 | Lin | 292/167 |
| 4,664,433 | 5/1987 | Solovieff | 292/337 |
| 4,682,482 | 7/1987 | Hall | 70/129 |
| 4,687,239 | 8/1987 | Lin | 292/172 |
| 4,708,379 | 11/1987 | Ching | 292/337 |
| 4,711,477 | 12/1987 | Fann et al. | 292/169.14 |
| 4,718,706 | 1/1988 | Fang | 292/337 |
| 4,725,086 | 2/1988 | Shen | 292/337 |
| 4,729,585 | 3/1988 | Lin | 292/337 |
| 4,729,586 | 3/1988 | Fang | 292/337 |
| 4,736,973 | 4/1988 | Fang | 292/337 |
| 4,746,154 | 5/1988 | Fang | 292/337 |
| 4,750,766 | 6/1988 | Shen | 292/337 |
| 4,752,090 | 6/1988 | Lin | 292/1 |
| 4,767,140 | 8/1988 | Lin | 292/337 |
| 4,768,817 | 9/1988 | Fann et al. | 292/337 |
| 4,804,216 | 2/1989 | Marotto | 292/337 |
| 4,890,871 | 1/1990 | Lin | 292/337 |
| 4,921,290 | 5/1990 | Dietrich | 292/337 |
| 4,927,195 | 5/1990 | Wu et al. | 292/1.5 |
| 4,988,133 | 1/1991 | Shih | 292/191 |
| 5,102,175 | 4/1992 | Wu et al. | 292/337 |

FOREIGN PATENT DOCUMENTS 524726 5/1956 Canada .

*Primary Examiner*—Richard E. Moore

*Attorney, Agent, or Firm*—Myron B. Kapustij; Malcolm L. Sutherland

[57] ABSTRACT

A door latch having an adjustable backset position which allows it to be used in doors having either a $2\frac{3}{8}''$ backset or a $2\frac{3}{4}''$ backset. The latch includes a latch housing having two longitudinally spaced apart openings in communication with each other via a passageway. A cam is movable between the two openings through the passageway to adjust the backset. The cam cooperates with a retract slide which is engaged at its front end with the latch bolt to retract the latch bolt. The retract slide contains two sets of teeth at its back end, one set of teeth being engaged by the cam when it is in a first backset position and the second set of teeth being engaged by the cam when it is in a second backset position. The door latch also has a burglary deterrent feature comprising a dead bolt bar assembly which is in a retracted position when the door is closed and in an extended position when the door is open. The dead bolt bar assembly includes a blocker plate which, when the dead bolt bar is in a retract position, is activated by the dead bolt bar and prevents retraction of the latch bolt.

19 Claims, 7 Drawing Sheets

DOOR LATCH WITH ADJUSTABLE BACKSET AND DEADLOCKING FEATURE

RELATED APPLICATION

This application is a continuation in-part application of copending application Ser. No. 845,417, filed Mar. 3, 1992, now U.S. Pat. No. 5,169,184.

FIELD OF THE INVENTION

This invention relates to door latches and, in particular, to a door latch having an adjustable backset to accommodate a specific door configuration.

BACKGROUND OF THE INVENTION

Typically, doors are provided with a standard backset which defines the distance between the rotational axis of the operating knob and the edge of the door from which the latch bolt extends. Most modern doors are provided with a backset of 2¾" while older doors and a minority of modern doors have a backset of 2⅜". Thus, if the door hardware needs to be replaced, the user must locate a door latch which has the identical backset. Accordingly, hardware suppliers must stock latches for both types of backsets.

Adjustable backset door latches have been developed which utilize various mechanisms to vary the distance between the door edge and the rotational axis of the latch knob. However, the available space within the door is limited and therefore the length of the latch must correspond to the door configuration. Several prior known latches with adjustable backsets employ telescopingly extendable mechanisms which require additional preparation of the door. Still other designs comprise complicated mechanisms which can not be cost-effectively manufactured or have an unacceptable failure rate.

Adjustable backset door latches including dead bolts are also known. Employment of deadlocking latches is useful for the purpose of reducing or deterring tampering with a lock mechanism so that the latch or lock mechanism once locked is not readily manipulated into an unlocked position by unauthorized persons. In dead locking mechanism the tendency has heretofore been to build a considerable ruggedness into the mechanism. Because of the growing tendency to reduce the size of casings and housings for cylinder lock sets and tubular lock sets, dead latch mechanisms which have been constructed in an attempt to emphasize security have been complicated to a considerable degree and have necessitated careful machining of close-fitting parts in order to make certain that the dead latch mechanism operates with the consistency and security expected. The designs and constructions thus employed heretofore have invariably resulted in an expensive construction which has made the retail price of lock hardware of this type very expensive.

SUMMARY OF THE INVENTION

The present invention provides a door latch which is simple in construction, readily adaptable to existing door configurations, includes means for adjusting the backset thereof, and further includes burglary deterrent means.

The adjustable backset door latch of the present invention includes an actuating cam including a pair of radially extending teeth and having a rotational axis concentric with the rotational axis of the latch handle.

A retract slide is engaged at the front end thereof with the latch bolt and cooperates with the actuating cam to retract the latch bolt upon rotation of the actuating cam. The retract slide includes two pairs of laterally extending teeth, a front pair and a rear pair, at its rear end which are adapted to be engaged by the teeth of the actuating cam upon rotation of the actuating cam. Engagement of the teeth of the retract slide by the teeth of the cam forces the retract slide rearward thereby retracting the latch bolt head. The cam is rotatably mounted in case halves which enclose the operating mechanism. A latch spring has one end thereof mounted in one case body and the other end in abutment with the latch head. The latch spring biases the latch head to an extended position.

The case halves include a double recess opening adapted to selectively receive the rotational axis of the actuating cam. In a first or front recess, the cam pivots at a first backset position and in a second or back recess the cam pivots at the other backset position. In the first recess the teeth of the cam engage the front teeth of the retract slide while in the second recess the teeth of the cam engage the rear teeth of the slide. The actuating cam is prevented from inadvertently moving from one recess to the other by a constricted passageway between the two recesses. When it is desired to change the backset of the latch, the cam is manually forced through the constricted passageway from one recess to the other.

The door latch also includes a dead locking bar by means of which manipulation of the latch bolt when the door is locked is prevented by the interposition of a catch behind the latch bolt activated by the dead locking bar.

DETAILED DESCRIPTION OF THE PREFERRED EMBODIMENT

Figure 1:
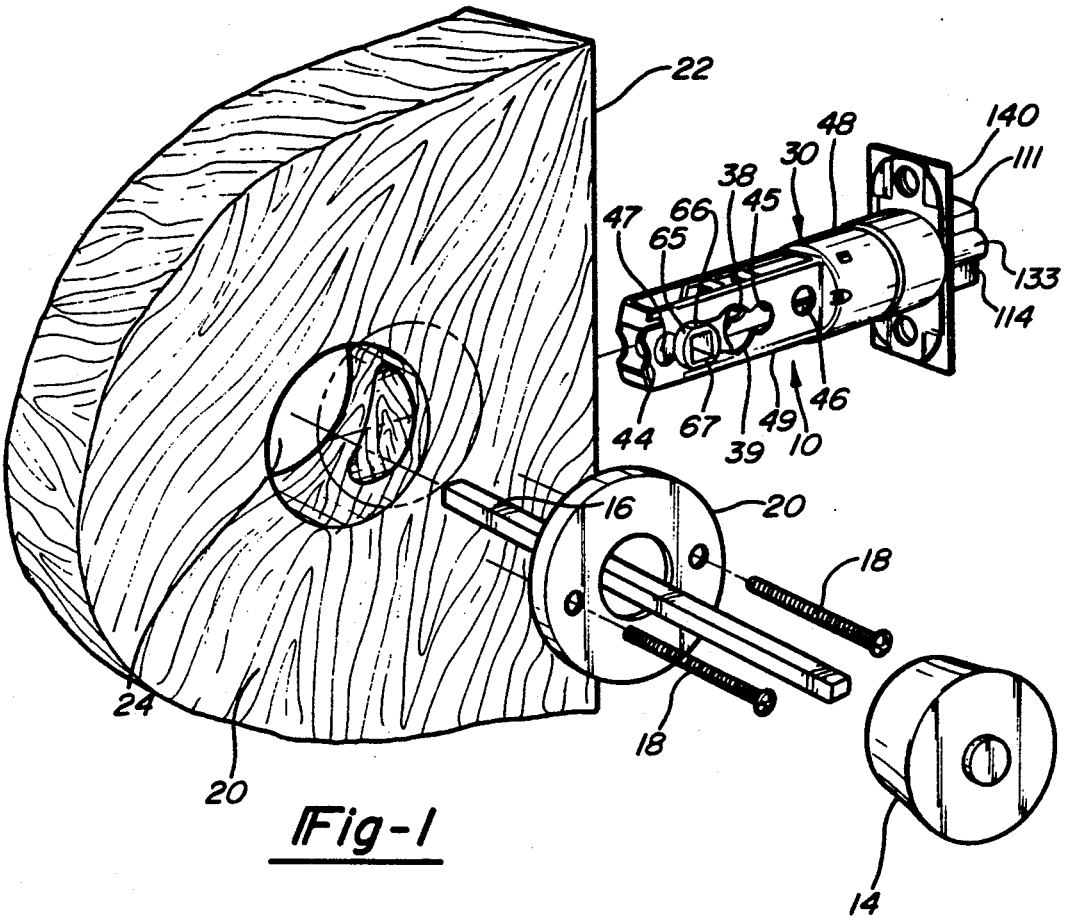
FIG. 1 is an exploded perspective view of a door latch assembly of the instant invention in conjunction with a door.
Figure 2:
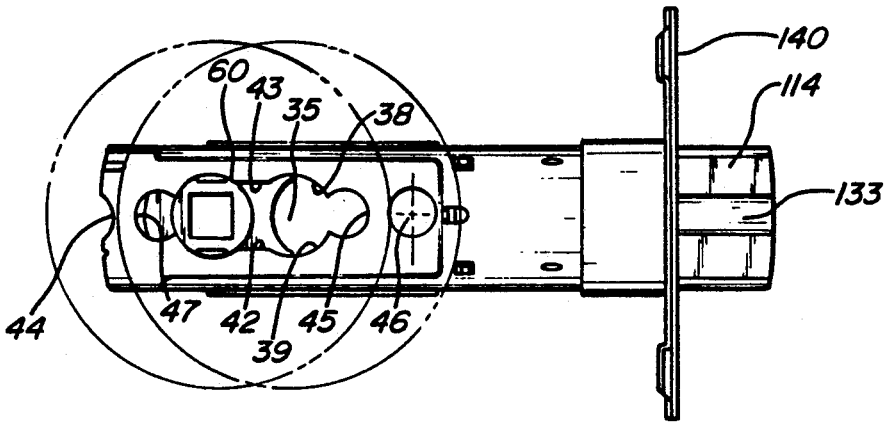
FIG. 2 is a side elevational view of the door latch assembly of the instant invention with the backset adjusted in its 2¾" or rearward position.
Figure 19:
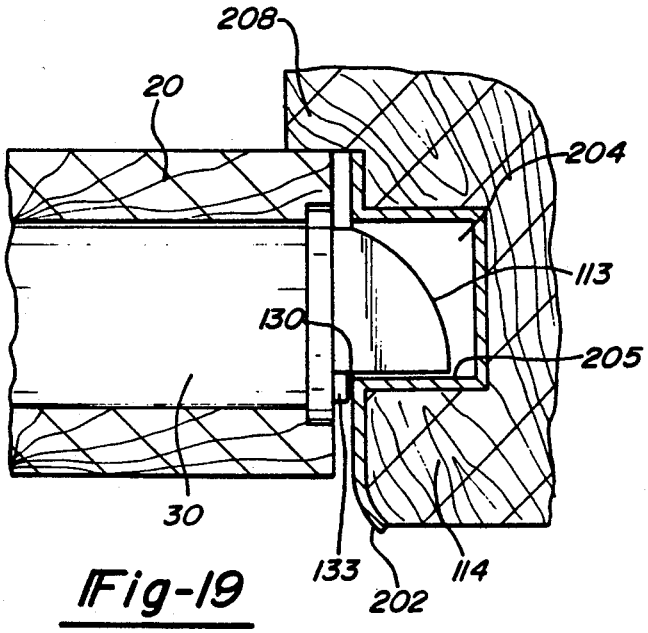
FIG. 19 is a side sectional view of a closed door which shows the latch bolt fully extended resting in the latch receiving hole with the deadlocking bar suppressed by the strike plate so that the blocker plate prevents the latch bolt from being pushed in or retracted by force.

Referring first to FIG. 1, there is shown a latching mechanism 10 embodying the present invention mountable within a door 12. The latching mechanism 10 includes an operating handle 14 for latching and unlatching mechanism 10. The operating handle 14 may be in the form of a knob, a lever or a key lock and includes a spindle 16 which forms the rotational axis of operating handle 14. A similar operating means may be provided on the other side of the door 20. The operating handle 14 and latching mechanism 10 are retained within the door 12 by mounting bolts 18 which extend through the rose 20 and the latching mechanism 10. The present invention provides a latching mechanism 10 whereby the backset distance between the door edge 22 and the rotational axis of the operating handle 14 can be selectively adjusted between a 2154 " backset and a 2¾" backset. Since both old and new doors 12 may be provided with a throughbore 24 it is advantageous that the latching mechanism 10 can be altered to accommodate the positioning of the bore 24 relative to the door edge 22. The present invention also includes a burglary deterrent feature which prevents retraction of the latch bolt head 111 when the door is in the closed position as illustrated in FIG. 19.

Figure 6:
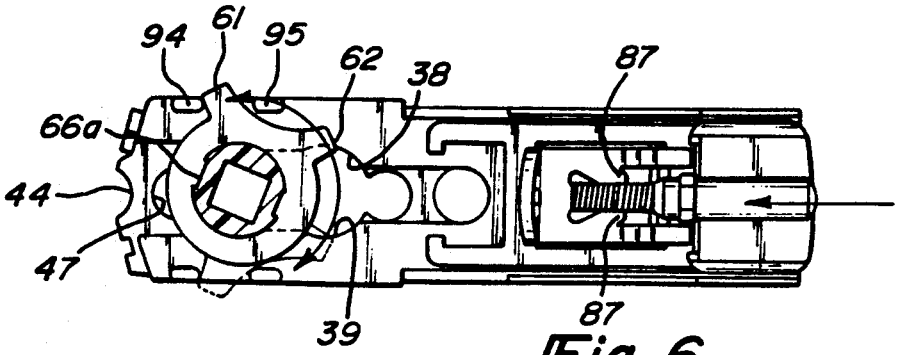
FIG. 6 is a view similar to FIG. 4 except that the actuating cam is in the rear backset position.
Figure 7:
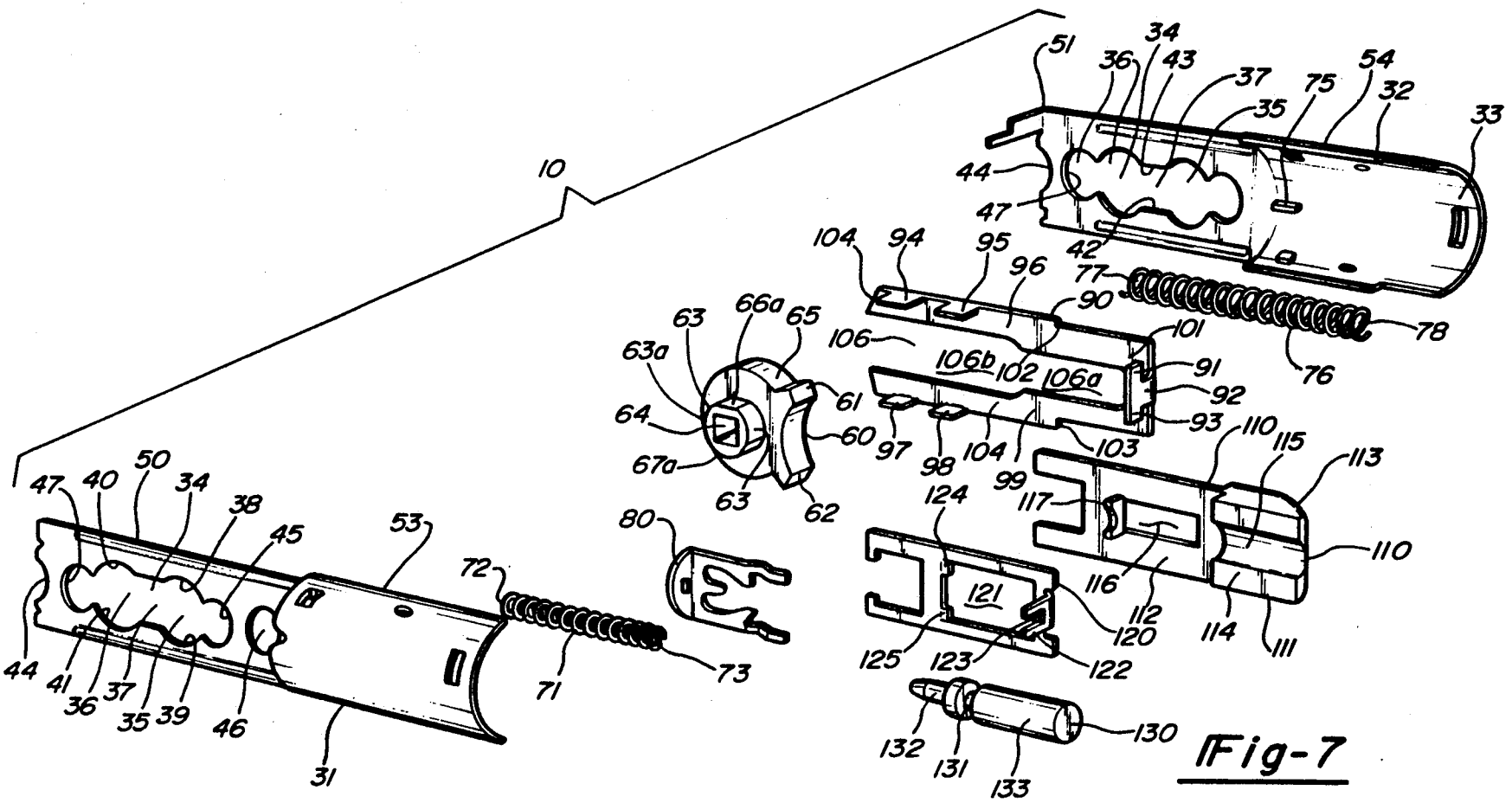
FIG. 7 is an exploded perspective view of the door latch assembly of the instant invention.

Referring now to FIGS. 1 and 7 of the drawings, the latching mechanism 10 includes a hollow latch housing 30 adapted to retain and house the components of the mechanism 10. For ease of manufacture and assembly the latch housing 30 includes a pair of housing halves 31 and 32 adapted to be matingly assembled. The latch housing 30 includes at least one open end 33 through which latch bolt head 111 of latch bolt element 110 is slidable longitudinally back and forth between an inwardly retracted position (FIGS. 4 and 6) and an outwardly extended position (FIGS. 3, 5, 15, 16, 17, 18 and 19). To provide support of the assembled housing 30 and facilitate fixed mounting of the latch mechanism 10 within the outer edge 22 of the door 20, a face plate assembly 140 or a drive-in collar may be attached to the housing open end 33 and secured to the door 20 in an appropriate manner. Once secured, the latch bolt head 111 can be shifted between a retracted position (FIG. 4) and an extended position (FIG. 3) to unlatch and latch the door 20, respectively.

As best illustrated in FIG. 1 latch housing 30 includes a front portion 48 which is generally tubular and a rear portion 49 which is generally box shaped, said box shaped rear portion 49 generally having a rectangular cross-section and being open at the top and bottom. The front portion is comprised of two semi-cylindrical sections 53 and 54. The rear portion 49 of latch housing 30 is comprised of two flat plates 50 and 51. In the preferred embodiment as illustrated, the rear portion 49 is preferably formed integral with the front portion 48. That is to say, each latch housing half 31 and 32 is preferably a single unit which contains flat plates 50 and 51, respectively, of the rear portion 49 integrally formed with semi-cylindrical sections 53 and 54, respectively, of the front portion 48.

The latch housing halves 31 and 32 include aligned double recess openings 34 in the flat plates 50 and 51 of the rear portion 49. The aligned openings 34 control the backset position of the operating handle 14 with respect to the latching mechanism 10. The aligned openings 34 include a first or front recess or opening 35 and a second or rear recess or opening 36 with a constricted passageway 37 defined by a dividing wall portion of the housing 30 therebetween. Tops 38 and bottoms 39 of openings 35 are generally concave and comprise arcs of a circle. Similarly, tops 40 and bottoms 41 of openings 36 are also concave and comprise arcs of a circle having the same radius as the circle of which top 38 and bottom 39 are arcs. Top 43 and bottom 42 sections of the dividing wall portion are generally linear, parallel to each other, and closer to each other than the top 38 of opening 35 is to bottom 39 and top 40 of opening 36 is to bottom 41, thereby defining a constricted passageway 37 between opening 35 and opening 36. In a preferred embodiment of the present invention additional openings or notches are provided to receive mounting bolts 18 through the latch housing 30 in order to fixedly mount the latch 10 within the door 20 depending upon the backset position of the latching mechanism 10. In a preferred configuration notch 44 in the end of latch housing 30 cooperates with the end notch 45 of opening 34 to form a first set of openings to receive the mounting bolts 18 in a first or rear backset position while aperture 46 in the latch housing 30 cooperates with a second end notch 47 of opening 34 to form a second or front set of openings to receive the mounting bolts 18 in a second backset position.

Latch bolt element 110 is reciprocatably mounted within the housing 30. The latch bolt element 110 includes a latch bolt head 111 and a latch bolt tail 112. The latch bolt head 111 includes a generally tapered face 113 adapted to engage the striker plate 202 and a substantially flat abutment face or surface 114. An elongated substantially semi-circular groove 115 extends longitudinally along the flat abutment surface 114. The elongated groove 115 is adapted to receive the front cylindrical portion 133 of deadlocking bar 130. The latch bolt element 110 preferably consists of one piece, with the latch bolt tail 112 preferably formed integrally with or fixedly attached to, as for example by staking or displacing metal, the latch bolt head 111.

Figure 12:
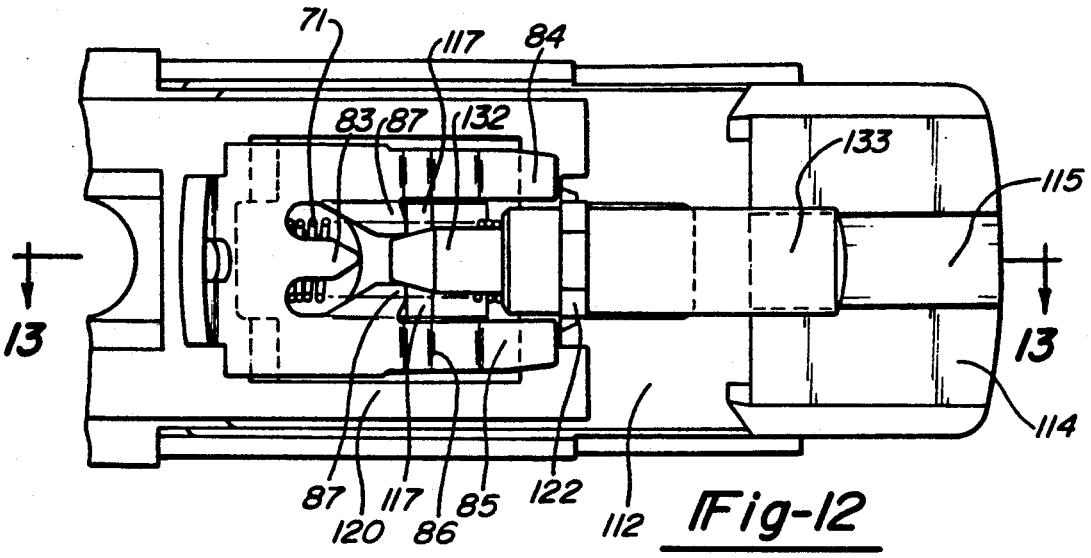
FIG. 12 is a sectional side view of the forward portion of the latch assembly with the deadlocking bar partially retracted and the blocker plate acting to block the inward thrust of the latch bolt. This occurs by the blocker plate dropping down to engage the tab on the latch tail slide thereby blocking further retraction of the latch bolt after the latch bolt has moved inwardly a short distance.
Figure 13:
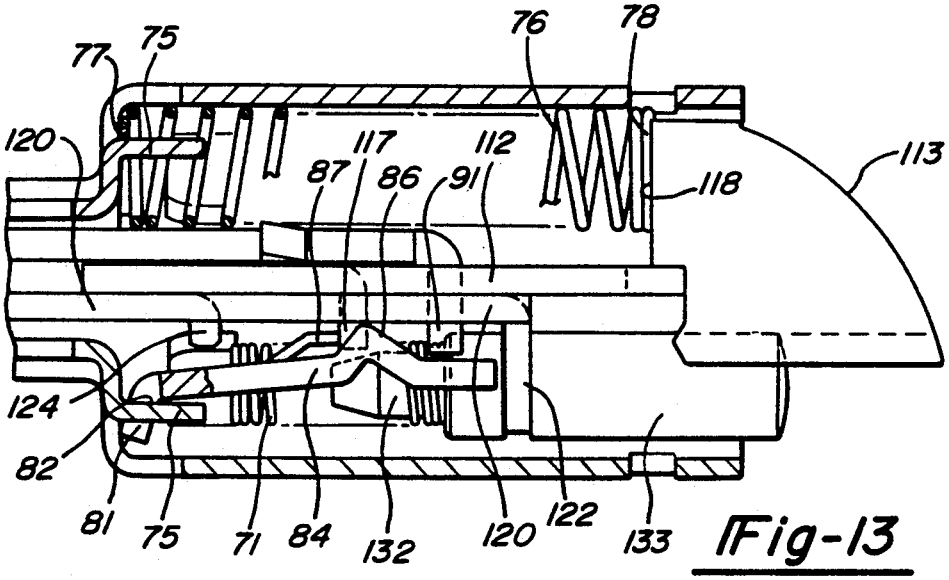
FIG. 13 is a section taken along line 13—13 of FIG. 12.

The latch bolt tail 112 is preferably disposed intermediate the opposite faces 113 and 114 of the latch bolt head 111. Latch bolt tail 112 consists of an H-shaped plate having a substantially rectangular opening 116 intermediate its front and rear ends cooperating with retract slide 90 as described hereinafter so that the latch bolt element 110 can be pulled rearwardly (to a retracted position) by retract slide 90. An outwardly extending tab 117 is disposed at the rear of opening 116. Tab 117 cooperates, as described hereinafter, with blocker plate 80 to prevent retraction of latch bolt element 110 into the interior of latch housing 30 when the door is in a closed position with the deadlocking bar 130 in a retracted position as shown in FIG. 19 or in a partially retracted position as shown in FIGS. 12 and 13.

The retract slide 90 comprises a flat plate including at its front end a hook 92 extending generally perpendicularly to said flat plate with two outwardly directed projections 91 and 93 adapted to extend through the opening 116 of the latch bolt tail 112. The flat plate comprises a pair of longitudinally extending spaced apart legs 96 and 99 defining an opening 106 therebetween. The legs 96 and 99 are narrower at their rear sections than at their front sections thereby resulting in opening 106 being narrower at its front **106*a* than at its rear 106*b*. Rear 106*b* of opening 106 is sized to receive hub section 63*b* of latch cam 60. Retract slide 90 further includes at its rear a pair of outwardly extending teeth 94 and 95 in its upper leg 96 and a pair of outwardly extending teeth 97 and 98 in its lower leg 99 against which teeth 61 or 62 latch cam 60 are adapted to bear when turned either clockwise or counterclockwise by rotation of spindle 16**.

Teeth 94 and 95 are engaged by tooth 61 of latch cam 60 while teeth 97 and 98 are engaged by tooth 62 of latch cam 60. More specifically, when latch cam 60 is disposed in opening 35 clockwise rotation of latch cam 60 will cause tooth 62 to engage tooth 98 of retract slide 90 while counterclockwise rotation of latch cam 60 will cause tooth 61 to engage tooth 95, resulting in retraction or rearward movement of retract slide 90. When latch cam 60 is disposed in opening 36 clockwise rotation of latch cam 60 will cause tooth 62 to engage tooth 97 of retract slide 90 while counterclockwise rotation of latch cam 60 will cause tooth 61 of latch cam 60 to engage tooth 94, of retract slide 90 resulting in retraction or rearward movement of retract slide 90. The engagement of tooth 61 with teeth 95 or 94, or tooth 62 with teeth 98 or 97, translates either clockwise or counterclockwise rotational movement of the operating handle 14 and, therefore, actuating cam 60 into a rearward or retractional longitudinal movement of the retract slide 90 and, consequently of the latch bolt element 110.

The forward or front portion 101 of the retract slide 90 is narrower than the back or rear portion 104, thereby forming two shoulders 102 and 103. The width of the front portion 101 is less than the internal diameter of the tubular front portion 4 of the latch housing 30. The front portion 101 of the retract slide 90 is thus sized to fit within the tubular front portion 48 of the housing 30. The back portion 104 of the retract slide 90 is wider than the internal diameter of the tubular front portion 48 of the latch housing and is, therefore, unable to fit within said tubular front portion. The shoulders 102 and 103 of the retract slide thus limit the longitudinal movement of retract slide 90 into the interior of the tubular front portion 48.

The latch bolt head 111 and latch bolt tail 112 are adapted to move independently of the retract slide 90 so that the latch bolt head 111 can shift as it strikes the striker plate without the necessity of the latch cam 60 and operating handle 14 rotating.

Figure 8:
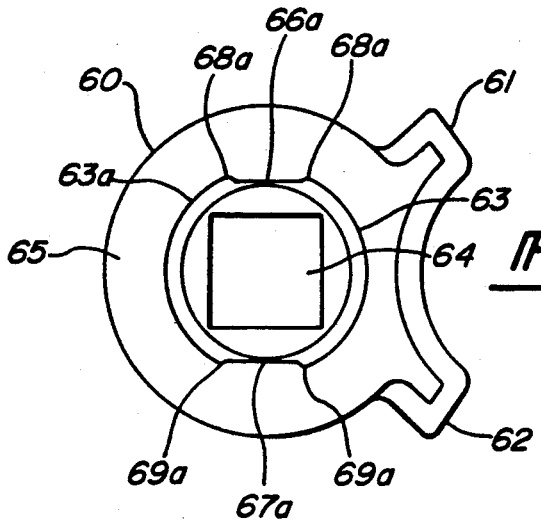
FIG. 8 is a right side elevational view of the latch cam.
Figure 9:
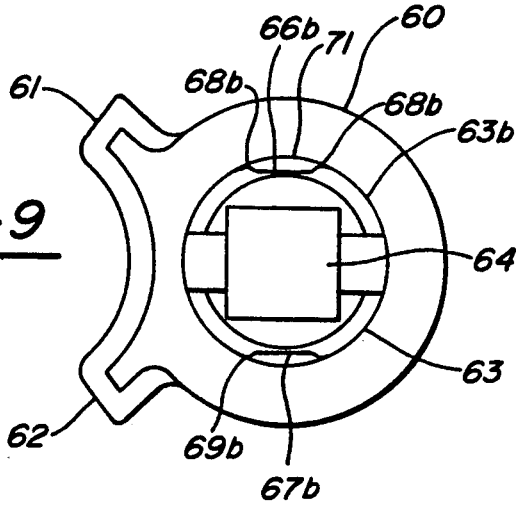
FIG. 9 is a left side elevational view of the latch cam.
Figure 10:
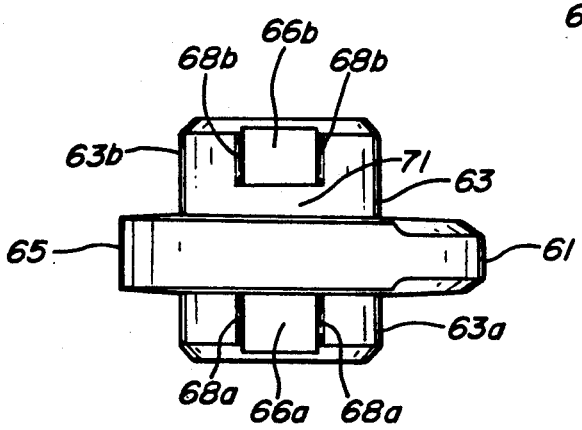
FIG. 10 is a top plan view of the latch cam.
Figure 11:
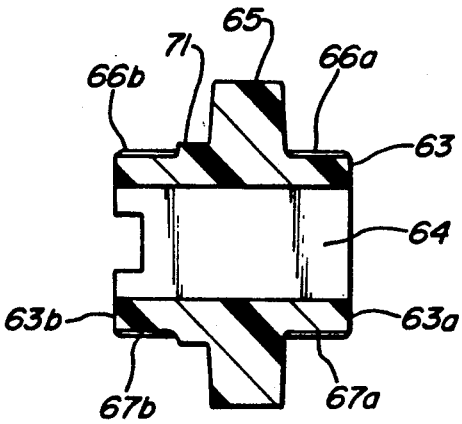
FIG. 11 is a front sectional view of the latch cam

The latch cam 60 includes a central camming section 65 having radially extending teeth 61 and 62, and a hub 63 about which latch cam rotates. The hub 63 includes a hub bore 64 configured to receive spindle 16 such that as the operating handle 14, which is attached to spindle 16, is rotated the latch cam 60 will be rotated accordingly. In a preferred embodiment the bore 64 is polygonal, preferably square or rectangular, in shape. The hub 63 extends laterally on both sides of latch cam 60 and, as best illustrated in FIGS. 10 and 11, comprises two hub sections **63*a* and 63*b* on either side of central camming section 65. As best illustrated in FIGS. 10 and 11 hub section 63*b* is longer than hub section 63*a* by an amount substantially equal to the thickness of retract slide 90. As best shown in FIGS. 8 and 9, hub sections 63*a* and 63*b* have outer surfaces which are generally circular in cross-section. The outer diameter of the circular in cross-section outer surfaces of hub sections 63*a* and 63*b* is greater than the distance between tops 43 and bottoms 42 of the constricted passageway 37 between openings 35 and 36 in aligned openings 34. That is to say, this outer diameter is greater than the width of the constricted passageways 37. Two axially extending shallow grooves 66*a* and 67*a* are provided in the outer top and bottom surfaces respectively of hub section 63*a*. The grooves 66*a* and 67*a* have flat surfaces and extend axially along the entire length of hub section 63*a*. The grooves 66*a* and 67*a* are circumferentially spaced apart from each other by about 180°. The outer diameter of hub section 63*a* is smallest at these two flat grooves 66*a* and 67*a*. This outer diameter is generally slightly less than the distance between flat tops 43 and bottoms 42 of the constricted passageways 37 between openings 35 and 36. That is to say, this outer diameter is less than the width of the constricted passageways 37**.

Two axially extending shallow grooves **66*b* and 67*b* are provided in the outer top and bottom surfaces respectively of hub section 63*b*. The grooves 66*b* and 67*b* have flat surfaces and are circumferentially spaced apart from each other by about 180°. Grooves 66*b* and 67*b* do not extend along the entire length of hub section 63 but, as best shown in FIGS. 10 and 11, terminate short of central camming section 65 by a distance substantially equal to the thickness of the retract slide 90. Thus, the length of grooves 66*b* and 67*b* is substantially the same as the length of grooves 66*a* and 67*a*. Because grooves 66*b* and 67*b* terminate short of central camming section 65, the outer surface 71 of cam section 63*b* between the grooves 66*b* and 67*b* and central camming section 65 is circular in cross-section and functions as a bearing surface for retract slide 90. The outer diameter of hub section 63*b* is smallest at these two flat grooves 66*b* and 67*b*. This outer diameter is slightly less than the distance between the flat top 43 and bottom 42 of the constricted passageway 37 between openings 35 and 36. That is to say this outer diameter is less than the width of constricted passageway 37**.

The latch cam 60 is disposed in the door latch assembly with hub sections **63*b* being disposed in opening 106*b* of retract slide 90**.

Figure 3:
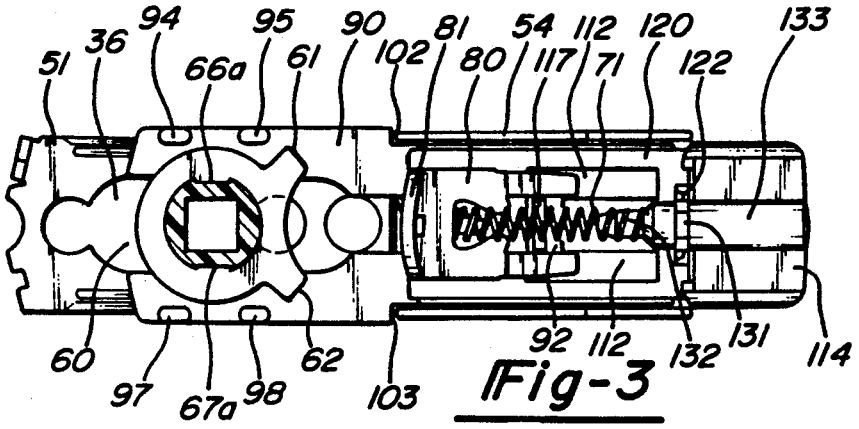
FIG. 3 is a side elevational view of the latch assembly shown in FIGS. 1 and 2 with one of the latch case halves separated from the other showing the latch bolt in an extended position and the actuating cam in the front backset position.
Figure 4:
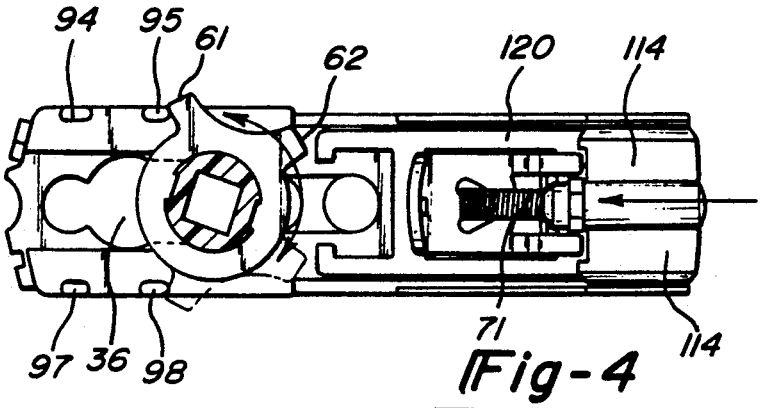
FIG. 4 is a view similar to FIG. 3 except that the latch bolt is in a retracted position.

In a backset position of 2⅜", as illustrated in FIGS. 3 and 4, the hub 63 is rotatably seated in front openings 35, while in a backset position of 2¾", as illustrated in FIGS. 1, 2, 5 and 6, the hub 63 is rotatably seated in rear openings 36.

To accomplish backset adjustment, e.g., move latch cam 60 from opening 35 to opening 36, the hub 63 is rotated so that the flat top and bottom sections **66*a*, 67*a***, 66*b* and 67*b* are aligned with linear top and bottom sections 43 and 42 of the constricted passageway 37. The hub 63 is then urged rearwardly through the constricted passageways until it clears said passageways and is seated in rear openings 36. To move latch cam 60 from rear openings 36 to front openings 35 the aforedescribed process is carried out in reverse, i.e., the hub 63 is moved from rear openings 36 through the restricted passageway 37 to front openings 35. While in the restricted passageway 37 the hub 63 cannot be rotated.

When the hub 63, which is preferably comprised of a plastic material, is urged through the constricted passageways 37 the circular in cross-section outer surfaces of hub sections 63*a* and 63*b*, being of greater diameter than the width or height of the restricted passageways 37, are compressed and deformed at 68*b*, 69*b*, 68*a* and 69*a* by the flat tops and bottoms 43 and 42 of the constricted passageways 37 thereby allowing passage of the hub 63 through the restricted passageway. Once the hub is out of the restricted passageway and seated in openings 35 or 36 these sections 68*b*, 69*b*, 68*a* and 69*a* return or snap back to their original shape, thereby preventing the hub from inadvertently moving from one backset to another. In order to move the hub through the constricted passageways it is necessary to push the hub into the passageways with sufficient force so that the sections 68*b*, 69*b*, 68*a* and 69*a* are compressed. Thus, accidental or unwanted change of backset position is prevented.

In the assembled state of latch mechanism 10 the retract slide 90 is disposed between the latch bolt element 110 and the latch housing half 32, with the hook 92 inserted through opening 116 in tail 112 of latch bolt element 110. The retract slide 90 is disposed on the side of the latch bolt element 110 opposite the substantially flat abutment surface 114 of latch bolt head 111, with the hook 92 extending through opening 116 and being disposed on the side of the latch bolt element 110 with the flat abutment surface 114.

Figure 17:
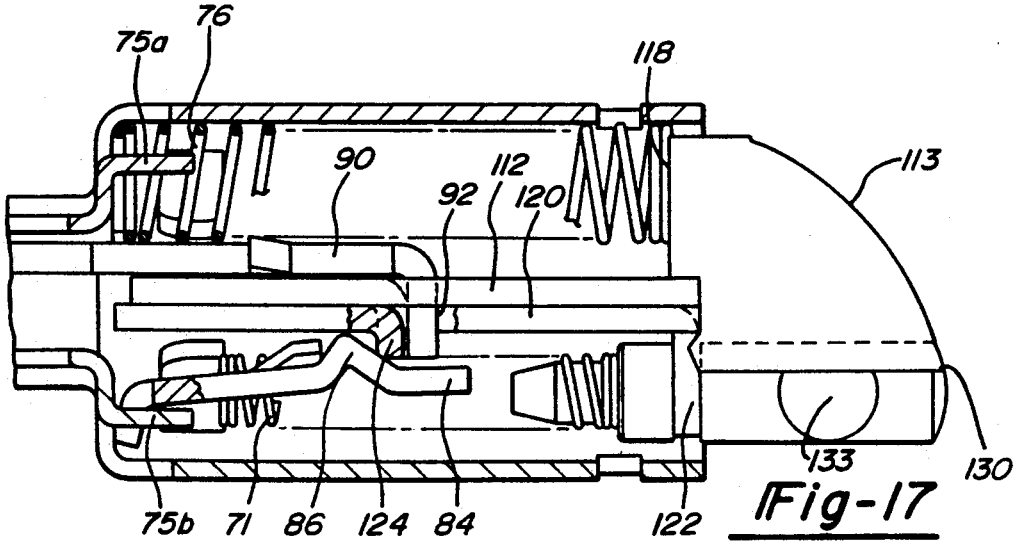
FIG. 17 is a section taken along line 17—17 of FIG. 15.

As best illustrated in FIGS. 13 and 17, a latch spring tab 75 projects forwardly from the interior wall of latch housing half 32 adjacent the rear end of the semi-tubular front portion 54 of latch housing half 32. One end 77 of latch compression spring 76 is mounted over latch spring tab 75. The other end 78 of latch spring 76 rests against latch spring abutment wall 118 which forms the back or rear surface of the tapered surface 113 of latch bolt head 111. Wall 118 is generally perpendicular to tapered surface 113, is preferably recessed, and forms an abutment surface for compression spring 76. The latch spring 76 is a coil spring which functions to bias the latch bolt head 111 to the extended position.

The dead bolt mechanism comprises a deadlocking slide 120 disposed adjacent to and in surface to surface contact with latch bolt tail 112 on the side of latch bolt tail 112 adjacent the flat abutment surface 114 of bolt head 111. Deadlocking slide 120 is comprised of an H-shaped plate having a generally rectangular opening 121 therein. A deadlocking bar support arm 122 extends outwardly from the H-shaped plate of deadlocking slide 120 at the front end of opening 121. A notch 123 is formed in the arm 122, which notch 123 is adapted to engage annular groove 131 in deadlocking bar 130. A pair of bent portions or tabs 124 and 125 project outwardly and over the opening 121 adjacent the two rear corners of opening 121 and form operating elements of the dead bolt mechanism. The opening 121 is sized to fit over upright tab 117 of latch bolt element 110 and hook 92 of retract slide 90.

Figure 14:
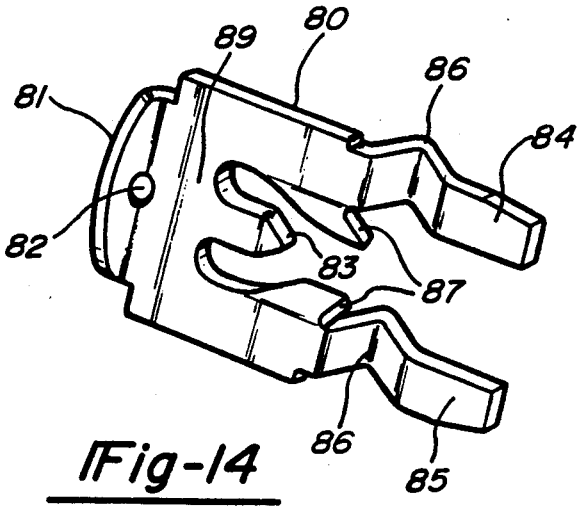
FIG. 14 is an enlarged perspective view of the blocker plate.

A deadlocking blocker plate 80 is disposed between deadlocking slide 120 and latch housing half 31. As best shown in FIG. 14 blocker plate 80 comprises a flat body section 89 having two longitudinally extending and laterally spaced apart legs 84 and 85 defining a space therebetween. Deadlocking blocker plate 80 includes a rear outwardly or upwardly bent portion 81 with an aperture 82 therein. As best illustrated in FIG. 13, Aperture 82 is engaged by a tab 75*a*, similar to tab 75*b*, projecting forwardly from the interior wall of latch housing half 31 adjacent the rear end of the semi-tubular front portion 53 thereof. A tongue 83 extends into the space between legs 84 and 85. The tongue 83 fits within one end 72 of deadlock compression spring 71. The other end 73 of spring 71 fits over the rear spring guide extension 132 of deadlocking bar 130. The deadlock spring 71 biases the deadlocking bar 130 to its extended position as best illustrated in FIG. 17.

A downwardly depending V-shaped camming surface 86 is provided on each of legs 84 and 85 located so that it is adapted to engage tabs 124 and 125 of the deadlocking slide 120 at certain positions of adjustment. Each leg 84 and 85 also has an downwardly extending blocking projection 87, disposed rearwardly of camming surface 86, adapted to engage tab 117 at certain positions of adjustment to prevent retraction of latch bolt element 110 into housing 30. Projections 87 and camming surfaces 86 extend in the same plane, which plane is generally perpendicular to the longitudinal axis of blocker plate 80. Camming surfaces 86 cooperate with tabs 124 and 125 of deadlocking slide 120 to prevent engagement blocking between projections 87 of blocker plate 80 With tab 117 of latch bolt tail 112, which engagement prevents retraction of latch bolt element 110 into housing 30.

Figure 18:
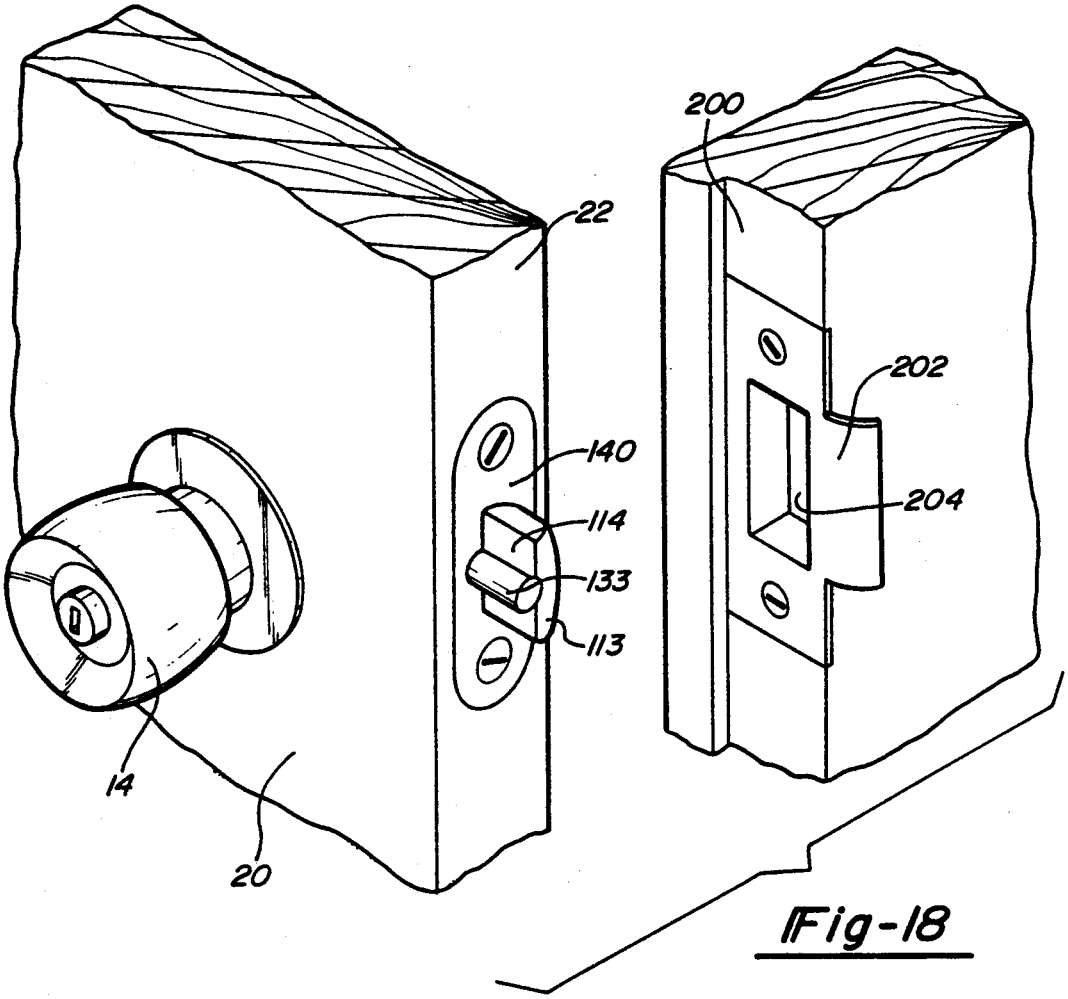
FIG. 18 is a perspective view showing the installed latch assembly on the door with the latch bolt and deadlocking bar fully extended as well as the latch bolt receiving hole and strike plate fixed to the door frame groove.

With the door in the open position, as shown in FIG. 18, the latch bolt head 111 is in an extended or neutral position due to the forward biasing action of latch spring 76 on latch spring abutment wall 118. With the latch bolt head 111 in its extended position, the latch bolt tail 112 is also in its forward position as illustrated in FIGS. 3, 5, 15, 16 and 17. With latch bolt tail 112 in the forward position, retract slide 90 is likewise in its forward position, as shown in FIGS. 3, 5, 15, 16 and 17, due to latch bolt tail 112, during its forward movement, pulling along with it retract slide 90 via abutment of tab 117 on latch bolt tail 112 against hook 92 on retract slide 90. The deadlocking bar 130 is also in its extended or neutral position due to the forward biasing action of deadlocking spring 71 upon deadlocking bar 130. As best illustrated in FIGS. 3, 5, 15, 16 and 17 deadlocking slide 120 is also in its forward position.

Retraction of the latch bolt head 111 and deadlocking bar 130 is accomplished by rotating the operating handle 14 in either a clockwise or counterclockwise direction. With the latch cam hub 63 disposed in the front notched opening 35 counterclockwise rotation of operating handle 14 causes counterclockwise rotation of spindle 16. Counterclockwise rotation of spindle 16 rotates the hub 63 and central camming section 65 in a counterclockwise direction as illustrated in FIG. 4. This results in tooth 61 engaging tooth 95 on retract slide 90 forcing retract slide 90 to move rearwardly. In the rearward movement of retract slide 90 hook 9 abuts against tab 117 of latch bolt tail 112, thereby pulling latch element 110, including latch bolt head 111, to the rear. Rearward movement of latch bolt head 111 compresses latch spring 76. In its rearward movement the back of latch bolt head 111, more particularly the back of flat abutment surface 114, abuts against the front of deadlocking slide 120 pushing it to the rear. In its movement to the rear deadlocking slide 120 carries with it deadlocking bar 130. Rearward travel of deadlocking bar 130 compresses deadlocking spring 71.

Figure 5:
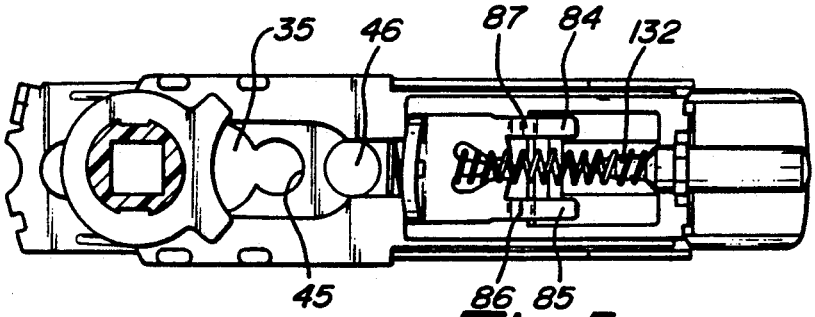
FIG. 5 is a view similar to FIG. 3 except that the actuating cam is in the rear backset position.

When the latch cam hub 63 is disposed in notched opening 36 as illustrated in FIGS. 5 and 6 the retraction sequence is the same as described supra with the exception that tooth 61 of latch cam 60 engages tooth 94 of retract slide 90 upon counterclockwise rotation of operating handle 14 and, tooth 62 of latch cam 60 engages tooth 97 of retract slide 90 upon clockwise rotation of operating handle 14.

With the door in a closed position, as illustrated in FIG. 19, the latch bolt head is in an extended position while the deadlocking bar 130 is in a retracted position. The latch bolt head 111 extends into latch bolt receiving case 204, while deadlocking bar 130 abuts against striker plate 202. In this configuration the latch bolt tail 112 and retract slide 90 are in their forward positions while the deadlocking slide 120 is in its rearward position.

If an attempt is made to force latch bolt head 111 to the rear, i.e., out of engagement with latch bolt receiving case 204, such as by use of a thin stiff material, e.g., credit card, the latch bolt element will move rearwardly only a fraction of an inch before the outwardly extending projections 87 of the blocker plate 80 engage tab 117 in the latch bolt tail 112 as best shown in FIG. 13, thereby preventing further rearward movement of latch bolt element 110.

As best illustrated in FIG. 13 the downwardly and inwardly extending blocking projections 87 of blocker plate 80 are able to engage tab 117 because the deadlocking slide 120 is in its rearward position and blocker plate 80 with blocking projections 87 is able to drop down into the opening 121 in deadlocking slide 120 whereby blocking projections 87 engage tab 117. If the deadlocking slide 120 is in its forward position, as when the door is open as shown in FIG. 18, the blocking projections 87 do not engage tab 117 because, as best illustrated in FIG. 17, the latch bolt tail 112 along with tab 117 are disposed forwardly of the blocking projections 87. Also the camming surfaces 86 are in contact with tabs 124 and 125 on deadlocking slide 120 and will cam the blocker plate 80 and blocking projections 87 upwardly out of engagement with tab 117.

As mentioned earlier the deadlock compression spring 71 is biased between tongue 83 of deadlocking plate 80 and spring guide extension 132 of deadlocking bar 130. It should be noted that tongue 83 lies slightly outside of the center line of legs 84 and 85, i.e., it extends slightly diagonally downwardly from flat body section 89 in a direction toward the V-shaped camming surfaces 86. Arranged in this fashion the spring 71 when compressed will bow outwardly into contact with the inner wall of housing half 31, thereby altering the application of spring force to a diagonal direction inwardly. The spring pressure thus applied tilts the blocker plate 80 in a counterclockwise direction as viewed in FIG. 13 whereby camming surfaces 86 and 87 engage tabs 124, 126 on deadlocking slid 120 at certain positions of adjustment and whereby the blocking projections 87 engage the tab 117 of latch bolt tail 112 at other position of adjustment.

Figure 15:
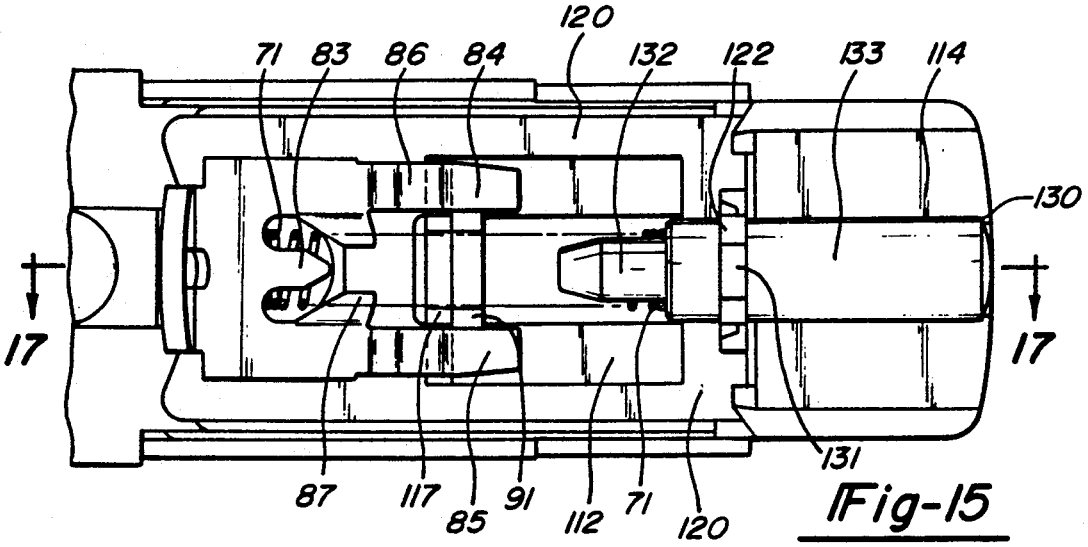
FIG. 15 is a view similar to FIG. 12 except with the deadlocking bar and latch bolt in a fully extended position and the blocker plate in a raised position.
Figure 16:
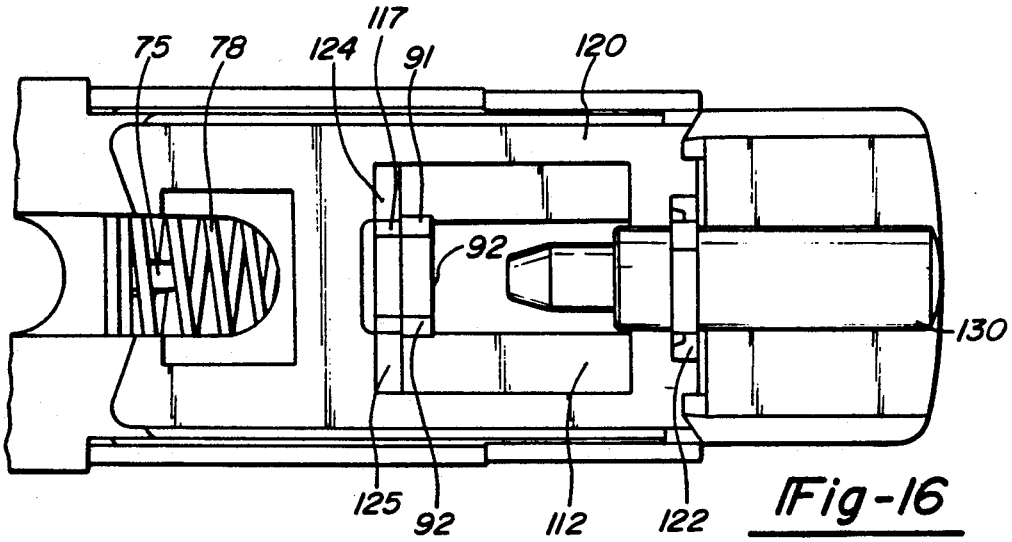
FIG. 16 is a view similar to FIG. 15 except with the blocker plate removed;.

If in the closed position of the door, illustrated in FIG. 19, the operating handle 14 is turned to retract the latch bolt element 110 and open the door, the retract slide 90 moves rearwardly pulling along with it latch bolt element 110. Rearward movement of latch bolt element 110 causes the tops of projections 91 and 93 of hook 92 to engage camming surfaces 86 of blocker plate. This results in blocker plate 80 being cammed upwardly, thereby disengaging blocking projections 87 from contact with tab 117 and allowing unimpeded rearward movement or retraction of latch bolt element 110. This is possible due to the fact that tab 117, as best illustrated in FIGS. 12 and 15, is narrower than the distance between legs 84 and 85 and fits between legs 84 and 85. Thus, the camming surfaces 86 on legs 84 and 85 do not engage tab 117. In its rearward movement latch bolt element 110 pushes deadlocking slide 120 rearwardly, thereby also causing rearward movement of deadlocking bar 130.

What is claimed is:

1. A latch mechanism including a rotatable operating handle mountable within a door having an adjustable backset distance between the door edge and the rotational axis of the operating handle, and further including a dead bolt mechanism, said latch mechanism comprising:

a housing comprising side walls and an open outer end;

a latch bolt element comprising a latch bolt head and a latch bolt body extending rearwardly of said latch bolthead reciprocable between extended and retracted positions mounted in said housing, said latch bolt head protruding from the open outer end of said housing in the extended position of said latch bolt element;

a retract slide operably engaged with said latch bolt body to move said latch bolt element to a retracted position within said housing; biasing means operably engaged with said latch bolt element moving said latch bolt element to the extended position;

an actuating cam means cooperating with corresponding first means and second means of said retract slide for moving said retract slide to a retracted position, said cam means having a first hub coaxial with the rotational axis of the operating handle;

said housing having aligned openings in said side walls to rotatably receive said hub of said actuating cam, said openings containing a first portion, a second portion and dividing means between said first portion and said second portion;

said hub of said actuating cam receivable in said first portion of said openings such that the rotational axis of the operating handle is positioned in a first backset position relative to said door edge, said means on said cam operating on said first corresponding means in said retract slide to move said retract slide and said latch bolt to a retracted position;

said hub of said actuating cam receivable in said second portion of said openings such that the rotational axis of the operating handle is positioned in a second backset position relative to said door edge, said means on said cam operating on said second corresponding means on said retract slide to move said retract slide and latch bolt to a retracted position;

said actuating cam selectively shiftable through said dividing means between said first and second portions of said openings in said housing side walls to adjust the backset distance of said latching mechanism; a dead bolt disposed on one side of said latch bolt head and having a parallel path of reciprocation;

a deadlocking slide engaged with said dead bolt adapted to move with said dead bolt;

a blocker plate actuated by said deadlocking slide tiltably mounted in the inner surface a side wall of said housing, said blocker plate tilting towards, engaging and blocking rearward movement of said latch bolt body at one position of said deadlocking slide and being tilted away from and disengaged from blocking rearward movement of said latch bolt body at another position of said deadlocking slide.

2. A latch mechanism including a rotatable operating handle mountable within a door having an adjustable backset distance between the door edge and the rotational axis of the operating handle, and further including a dead bolt mechanism, said latch mechanism comprising:

a housing comprising side walls and an open front end;

a latch bolt element comprising a latch bolt head and a latch bolt body extending rearwardly of said latch bolthead reciprocably mounted between extended and retracted positions in said housing, said latch bolt body including a blocking tab extending substantially transversely thereto, said latch bolt head protruding from the open front end of said housing in the extended position of said latch bolt element;

a retract slide operably engaged with said latch bolt body to move said latch bolt element to a retracted position within said housing;

biasing means operably engaged with said latch bolt element moving said latch bolt element to the extended position;

an actuating cam means cooperating with corresponding first means and second means of said retract slide for moving said retract slide to a retracted position, said cam means having a hub coaxial with the rotational axis of the operating handle;

said housing having aligned openings in said side walls to rotatably receive said hub of said actuating cam, said openings containing a first portion, a second portion and dividing means between said first portion and said second portion;

said hub of said actuating cam receivable in said first portion of said openings such that the rotational axis of the operating handle is positioned in a first backset position relative to said door edge, said means on said cam operating on said first corresponding means in said retract slide to move said retract slide and said latch bolt to a retracted position;

said hub of said actuating cam receivable in said second portion of said openings such that the rotational axis of the operating handle is positioned in a second backset position relative to said door edge, said means on said cam operating on said second corresponding means on said retract slide to move said retract slide and latch bolt to a retracted position;

said actuating cam selectively shiftable through said dividing means between said first and second portions of said openings in said housing side walls to adjust the backset distance of said latching mechanism;

a dead bolt disposed on one side of said latch bolt head and having a parallel path of reciprocation;

a deadlocking slide engaged with said dead bolt adapted to move with said dead bolt;

a blocker plate mounted on the inner surface of a side wall of said housing;

said blocker plate containing a pair of forwardly extending spaced apart, parallel legs, at least one of said legs having a downwardly and inwardly projecting blocking projection;

said blocker plate being tilted towards said latch bolt body at one position of said deadlocking slide, whereby said blocking projection engages said blocking tab on said latch bolt body thereby blocking retraction of said latch bolt body and of said latch bolt head;

said blocker plate being tilted away from said latch bolt body at another position of said deadlocking slide, whereby said blocking projection is disengaged from said blocking tab on said latch bolt body, whereby said latch bolt body and said latch bolt head can be retracted.

3. The latching mechanism as defined in claim 2 wherein said latch housing comprises a pair of cooperable housing halves jointed to house said actuating cam, said latch bolt, said retract slide and said biasing means, each of said housing halves having an opening with said first portion, said second portion and said dividing means to receive said hub of said actuating cam.

4. The latching mechanism as defined in claim 3 wherein said latch housing includes first and second apertures for receiving the mounting bolts of the operating handle to secure said latching mechanism within the door, the mounting bolts received in said first apertures when the operating handle is positioned in said first backset position of said latching mechanism and the mounting bolts received in said second apertures when the operating handle is in said second backset position of said latching mechanism.

5. The latching mechanism as defined in claim 3 wherein said dividing means comprises a restricted passageway formed from the wall of said housing halves between said first and second portions of said opening, said hub moving through said restricted passageway as said actuating cam is moved between said first portion and said second portion of said opening.

6. The latching mechanism of claim 5 wherein said means on said actuating cam comprise at least one radially extending tooth.

7. The latching mechanism of claim 6 wherein said means on said actuating cam comprise two radially extending circumferentially spaced apart teeth.

8. The latching mechanism of claim 6 wherein said first means on said retract slide comprise at least one laterally extending tooth engageable by said tooth on said actuating cam upon rotation of said actuating cam.

9. The latching mechanism of claim 7 wherein said second means on said retract slide comprise at least one laterally extending second tooth longitudinally spaced from said first tooth engageable by said tooth on said actuating cam upon rotation of said actuating cam.

10. The latching mechanism of claim 7 wherein said first means on said retract slide comprise two vertically spaced apart teeth, one of said vertically spaced apart teeth being engageable by one of the teeth on said actuating cam upon counterclockwise rotation of the actuating cam and the other of said vertically spaced apart teeth being engageable by the other of said teeth on said actuating cam upon clockwise rotation of said actuating cam.

11. The latching mechanism of claim 10 wherein said second means on said retract slide comprise two vertically spaced apart teeth being engageable by one of the teeth on said actuating cam upon counterclockwise rotation of the actuating cam and the other of said vertically spaced apart teeth being engageable by the other of said teeth on said actuating cam upon clockwise rotation of said actuating cam.

12. The latching mechanism of claim 11 wherein said retract slide comprises a flat plate being bifurcated into two longitudinally extending legs at one end thereof.

13. The latching mechanism of claim 12 wherein said hub of said actuating cam is receivable in an opening defined by said two longitudinally extending legs of said retract slide.

14. The latching mechanism of claim 13 wherein said hub is a bearing surface for said retract slide.

15. The latching mechanism of claim 2 wherein said blocker plate further includes a downwardly projecting camming surface on at least one of said legs, said camming surface adapted to engage a tab on said deadlocking slide thereby camming said blocking projection out of engagement with said tab of said latch bolt body.

16. The latching mechanism of claim 2 wherein said blocker plate is tilted towards said latch bolt body by a spring.

17. The latching mechanism of claim 16 wherein said spring is engaged at one end with said blocker plate and at the other end with said dead bolt.

18. The latching mechanism of claim 17 wherein said dead bolt is reciprocably movable independently of said bolt head.

19. The latching mechanism of claim 2 wherein said dead bolt is reciprocably moveable independently of said bolt head.

* * * * *